United States Patent [19]

Sugiyama et al.

[11] Patent Number: 4,506,602

[45] Date of Patent: Mar. 26, 1985

[54] IMPRESSION CYLINDER DEVICE OF SHEET-FED PRINTING PRESS WITH TURN-OVER MECHANISM

[75] Inventors: Hiroyuki Sugiyama, Toride; Masaaki Ishida, Ryugasaki, both of Japan

[73] Assignee: Komori Printing Machinery Co., Ltd., Tokyo, Japan

[21] Appl. No.: 515,349

[22] Filed: Jul. 19, 1983

[30] Foreign Application Priority Data

Jul. 23, 1982 [JP] Japan ..... 57-128477

[51] Int. Cl.[3] ..... B41F 21/04

[52] U.S. Cl. ..... 101/230; 101/409

[58] Field of Search ..... 271/309, 174; 101/232, 101/231, 230, 409

[56] References Cited

U.S. PATENT DOCUMENTS

| | | | |
|---|---|---|---|
| 2,757,610 | 8/1956 | Gegenheimer et al. | 101/230 |
| 2,931,647 | 4/1960 | Pape et al. | 101/230 |
| 4,024,814 | 5/1977 | Becker | 101/230 |
| 4,061,330 | 12/1977 | Yanagawa | 271/309 |
| 4,165,689 | 8/1979 | Giuiuzza | 101/230 |
| 4,343,241 | 8/1982 | Rudolph et al. | 101/231 |
| 4,384,524 | 5/1983 | Simeth et al. | 101/232 |
| 4,395,949 | 8/1983 | Jeschke | 101/231 |

FOREIGN PATENT DOCUMENTS

| | | | |
|---|---|---|---|
| 1561101 | 1/1970 | Fed. Rep. of Germany | 101/230 |
| 2164528 | 7/1973 | Fed. Rep. of Germany | 271/174 |
| 138627 | 11/1979 | German Democratic Rep. | 101/230 |
| 120351 | 9/1981 | Japan | 101/409 |
| 2045213 | 10/1980 | United Kingdom | 101/230 |
| 440279 | 1/1975 | U.S.S.R. | 101/230 |

*Primary Examiner*—William Pieprz

*Attorney, Agent, or Firm*—Charles E. Pfund

[57] ABSTRACT

In a sheet-fed printing press for the purpose of separating a sheet of paper adhereing to a peripheral surface of an impression cylinder, air is supplied to an interface between the peripheral surface of the impression cylinder and the paper clamping surface of a gripper support, from a source of supply through a pair of arcuate stationary air valves on both ends of the impression cylinder and an axial air passage near the peripheral surface of the impression cylinder.

3 Claims, 11 Drawing Figures

IMPRESSION CYLINDER DEVICE OF SHEET-FED PRINTING PRESS WITH TURN-OVER MECHANISM

BACKGROUND OF THE INVENTION

This invention relates to an impression cylinder device of a sheet-fed printing press with a turn-over mechanism in which the trailing end of a sheet of paper to be turned over is wound about the surface of the impression cylinder for sucking while maintaining the trailing end spaced from the impression cylinder surface.

Sheet-fed printing presses provided with various types of turn-over mechanism have been proposed for performing single side printing and double side printing with the same printing press. According to one type, a sheet of paper is sucked and turned over between an impression cylinder and a turn-over cylinder for performing the double side printing.

The printing press of this type comprises a blanket cylinder, an impression cylinder urged against the blanket cylinder and having a double diameter, and a turn-over cylinder urged against the impression cylinder and having a double diameter. When performing the double side printing with this printing press, after printing, the sheet of paper is gripped by the grippers of the impression cylinder and wrapped about the periphery of the impression cylinder until the trailing end of the sheet comes to confront the turn-over cylinder. Then the trailing end of the sheet is sucked by the suction device of the turn-over cylinder to be gripped by the turn-over gripper. The sheet of paper is conveyed while being turned over by the rotation of the turn-over cylinder. Thus, the turned-over paper sheet is transferred to the next printing cylinder to be printed on the rear surface, thus performing the double side printing.

However, the sheet of paper thus turned-over for performing the double side printing adheres to the periphery of the impression cylinder because the space between the sheet of paper and the impression cylinder is evacuated due to the pressure applied between the blanket cylinder and the impression cylinder during printing. Accordingly, it is difficult to peel off the sheet of paper away from the peripheral surface of the impression cylinder by the suction device for the purpose of turning-over the paper sheet. Accordingly the turn-over grippers offen fail to grip the sheet of paper.

SUMMARY OF THE INVENTION

Accordingly, it is an object of this invention to provide an improved impression cylinder device of a sheet-fed printing press with a turn-over mechanism capable of positively sucking the sheet of paper at the time of turning-over, thus preventing the turn-over grippers from failing to grip.

According to this invention there is provided a sheet fed printing press provided with a turn-over mechanism in which the trailing end of a sheet of paper wrapped about an impression cylinder is sucked by a suction device of a turn-over cylinder in contact with the impression cylinder and gripped by turn-over grippers to be turned over, characterized in that there is provided an air blow out opening at the interface between the paper clamping surface of a gripper support and the peripheral surface of the impression cylinder, the air blow out opening being formed in the gripper support of the impression cylinder, and means for connecting the air blow out opening to a source of air.

DESCRIPTION OF THE PREFERRED EMBODIMENT

Figure 1:
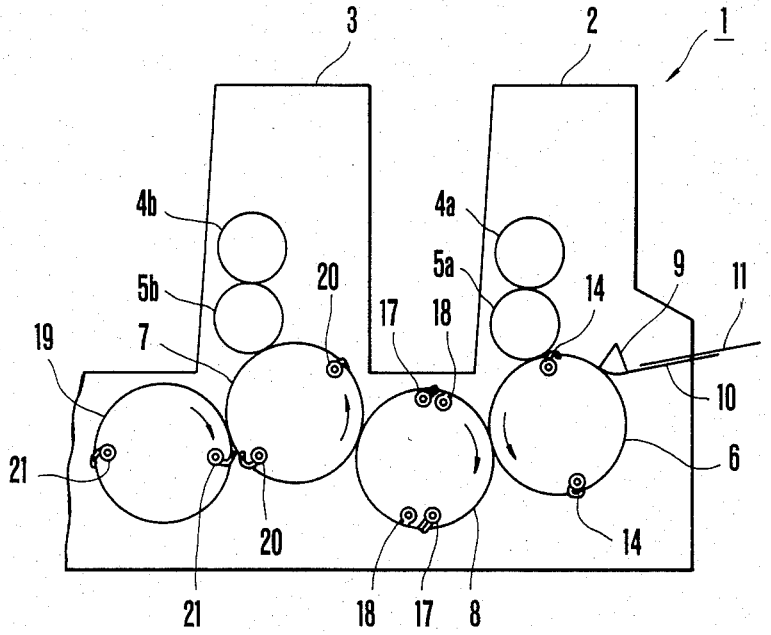
FIG. 1 is a side view showing one embodiment of the impression cylinder device of a sheet-fed printing press provided with a turn-over mechanism; according to this invention.

In a preferred embodiment of this invention shown in FIGS. 1 through 8, the first printing unit 2 and the second printing unit 3 of a printing press 1 respectively comprise plate cylinders 4*a* and 4*b* mounted with printing plates on their peripheries, inking apparatuses and water supplying apparatuses, not shown, respectively supplying ink and water onto the surfaces of the printing plates. Beneath the plate cylinders 4*a* and 4*b* are respectively disposed blanket cylinders 5*a* and 5*b* each having the same diameter as the plate cylinder 4*a* and 4*b*, the blanket cylinders 5*a* and 5*b* being urged against the plate cylinders 4*a* and 4*b* to be transfer-printed with picture images on the plate surfaces. Beneath the respective blanket cylinders 5*a*, 5*b* are positioned a first impression cylinder 6 and a second impression cylinder 7 with their peripheries in contact respectively with the blanket cylinders 5*a* and 5*b*, each impression cylinder having a diameter twice as large as that of the blanket cylinder 5*a* or 5*b*. A turn-over cylinder 8 having the same diameter as the impression cylinders 6 and 7 is interposed between them with their peripheries in contact with each other, a swing pregripper 9 swung by a cam mechanism is provided having grippers opened and closed by the cam mechanism so as to grip one end of the sheet of paper 11 fed one after another onto a feedboard 10 by a sheet feeder to supply the sheet to the first impression cylinder 6.

Figure 2:
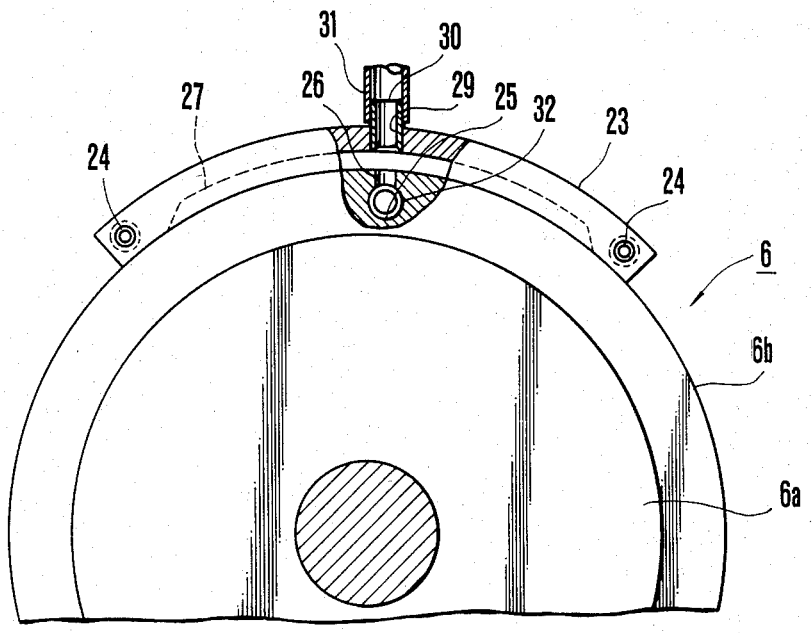
FIG. 2 is a side view of the impression cylinder, partly in section.
Figure 3:
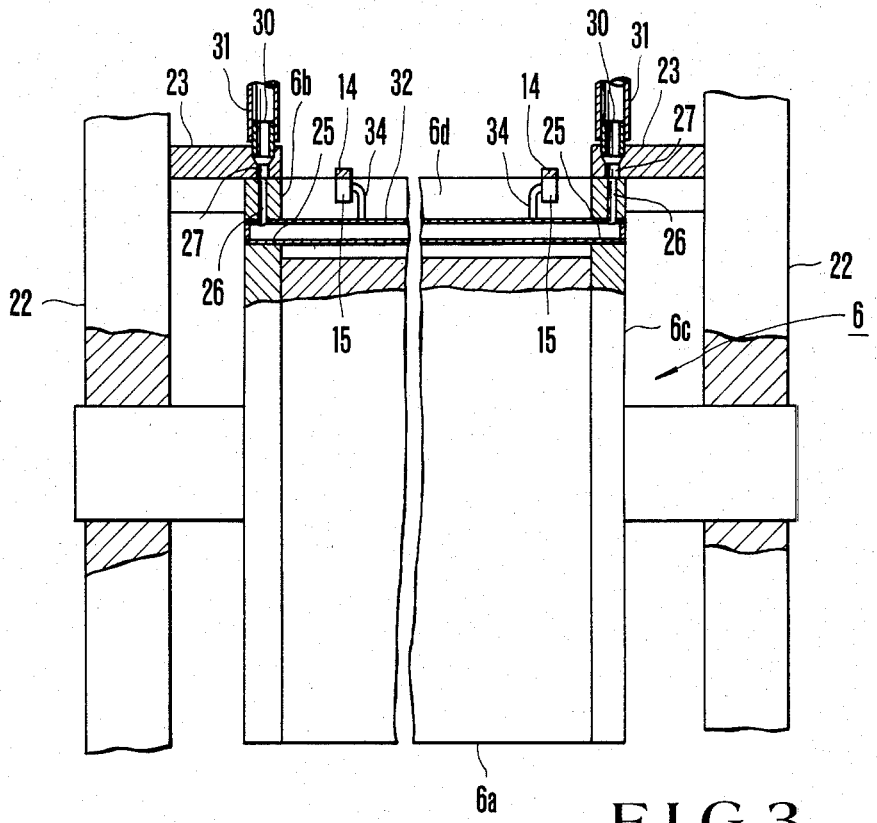
FIG. 3 is a longitudinal sectional view of the impression cylinder
Figure 4:
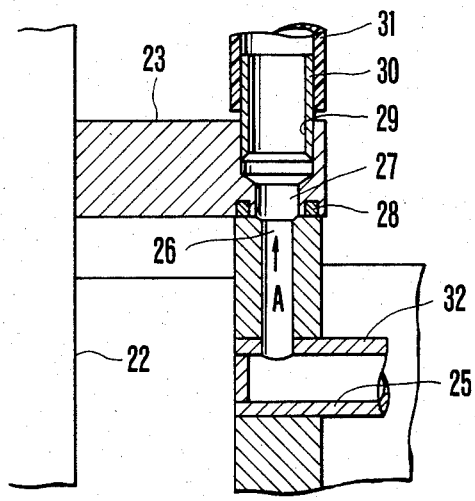
FIG. 4 is an enlarged sectional view of a valve member.
Figure 5:
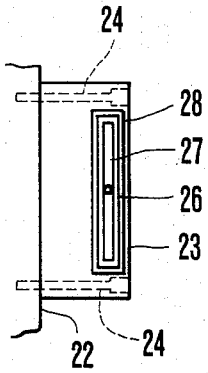
FIG. 5 is a developed view of the stationary valve as viewed in the direction of A shown in FIG. 4.
Figure 6:
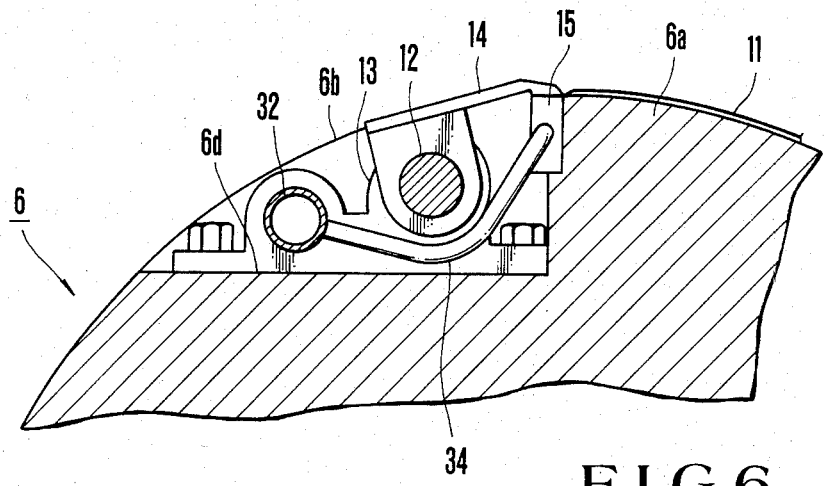
FIG. 6 is a sectional view showing a notch on the outer periphery of the impression cylinder.
Figure 7:
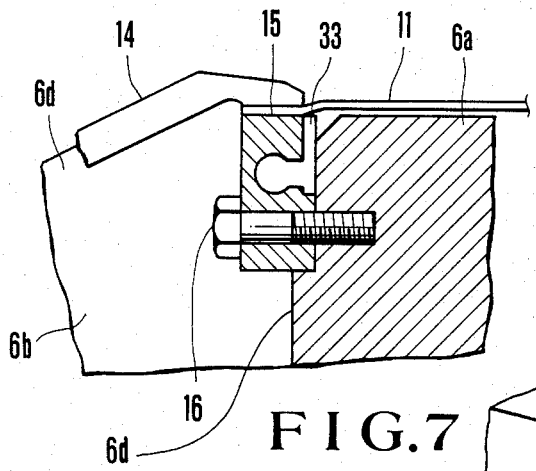
FIG. 7 is a sectional view showing a portion near the gripper support.

As shown in FIGS. 2 and 3, the first impression cylinder 6 is constituted by a main body 6*a* and a pair of disc shaped bearers 6*b* and 6*c*, and a pair of triangular notches 6*d* disposed at diametically opposite locations on the periphery of the main body 6*a* as shown in FIGS. 6 and 7. A gripper shaft 12 extends through each notch 6*d* and is journalled by a plurality of bearings 13 secured to opposing bearers 6*b* and 6*c* and to the inside of the notch 6*d* with bolts. A plurality of parallel grippers 14 are secured to the gripper shaft 12 through holders. A plurality of gripper supports 15 corresponding to respective grippers 14 are secured to the shoulder on the inner surface of the notch 6*d* so as to grip the sheet of paper with the grippers opened and closed by a cam mechanism at one shaft end. When the paper sheet 11 gripped by grippers 14 and gripper supports 15 is wrapped about the impression cylinder 6 as it rotates to pass between the nip between the blanket roller 5*a* and the impression roller 6 the image on the blanket roller 5 is transfer printed onto the paper sheet.

The turn-over cylinder 8 is provided with a pair of turn-over grippers 17 and a pair of suction devices 18 which are positioned in notches at diametrically opposing positions on the periphery of the turn-over cylinder 8. The phase between the two cylinders 6 and 8 is selected such that the turn-over grippers 17 and the suction devices 18 will oppose the trailing end of the sheet of paper gripped by grippers 14 and gripper supports 15 and wound about the periphery of the impression cylinder 6. The turn-over grippers 17 are opened and closed by cam mechanisms at the end of the cylinder 8 so as to grip the trailing end of the sheet of paper 11 and convey the same to the second impression cylinder 7 while turning over the sheet. Furthermore the turn-over grippers 17 are operated by the cam mechanisms described above so that the grippers swing in the opposite directions by about 180 degrees during one revolution of the turn-over cylinder 8, whereby the ends of the grippers are directed to the paper gripping direction and the paper releasing direction.

Each suction device 18 is provided with an air suction opening at the end surface thereof and has substantially the same construction as an air blowing device (to be described later) provided for the impresion cylinder 6. The trailing end of the paper sheet is sucked against the suction head by the suction device provided for the turn-over cylinder 8 so as to bring the trailing end of the paper sheet to a position at which the trailing end can be gripped by the turn-over grippers. The second impression cylinder 7 and a transfer cylinder 19 provided on the downstream side of the second impression cylinder 7 in contact therewith are respectively provided with grippers 20 and 21 having the same construction as the grippers 14 and the gripper supports 15 in notches at diametrically opposing positions.

To the left and right frames 22 adapted to support the first impression cylinder 6 are secured by bolts 24 a pair of arcuate stationary valves 23 having the same inner radii as the outer radii of the bearers 6*b* and 6*c*, so that the impression cylinder 6 is rotated with the peripheral surfaces of the bearers 6*b* and 6*c* in sliding contact with the inner peripheral surfaces of the stationary valves 23. An axial air passage 25 is formed near the outer surface of each of the bearers 6*b* and 6*c*, and an air port 26 is drilled from the outer peripheral surface to reach the air passage 25. The stationary valve 23 is provided with an arcuate slot 27 on its inner periphery having a sufficient length to follow the peripheral motion of the air port 26 over a substantial angle. An endless sealing member 28 is embedded in the stationary valve 23 to surround the slot 27 for maintaining air tightness between the stationary valve 23 and its associated bearer 6*b* or 6*c*. An opening 29 for connecting a hose is provided at the center of the slot 27. A fitting 30 in the form of a short pipe is fitted into the opening 29 and connected to a hose 31. Of the two hoses 31 connected to the left and right sides of the impression cylinder 6, one of the hoses is connected to a source of air, not shown, for supplying air to the air passage 26, while the other hose is connected to an air suction device, not shown, for sucking the air through the air port 26.

Figure 8:
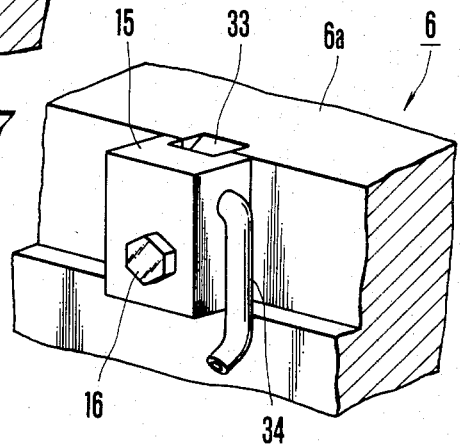
FIG. 8 is a perspective view of the portion shown in FIG. 7.

Air pipes 32 with both ends closed are fitted in the air passages 25 of the bearers 6*b* and 6*c* on both sides, and the intermediate portions of the air passages or pipes 32 are journalled by the bearings 13 which also support the gripper shafts 12. An air blow out opening 33 is formed between one side of each gripper support 15 and the side surface of the impression cylinder 6 to open at the interface between the paper gripping surface of the gripper support 15 and the periphery of the impression cylinder. Now it should be noted that one side of the opening 33 facing the side surface of the impression cylinder 6 is chamfered to form a recess having a triangular side form. A side opening of the air blow out opening 33 is connected to the air passage 32 through an air tube 34 as shown in FIG. 8. Then, the air supplied from the source of air is supplied to the air passage 32 from hose 31 via the slot 27 of the stationary valve 23 and the air port 26 and then blown to a gap between the paper sheet 11 and the peripheral surface of the impression cylinder 6 through air port 33. The timing of air blast is determined by the position of the stationary valve 23 and set to be in an interval between an instant immediately after the gripper support 15 has passed the contact point between the gripper support 15 and the turn-over cylinder 8 and an instant at which the trailing end of the paper sheet passes through the contact point between it and the turn-over cylinder 8.

Figure 9A:
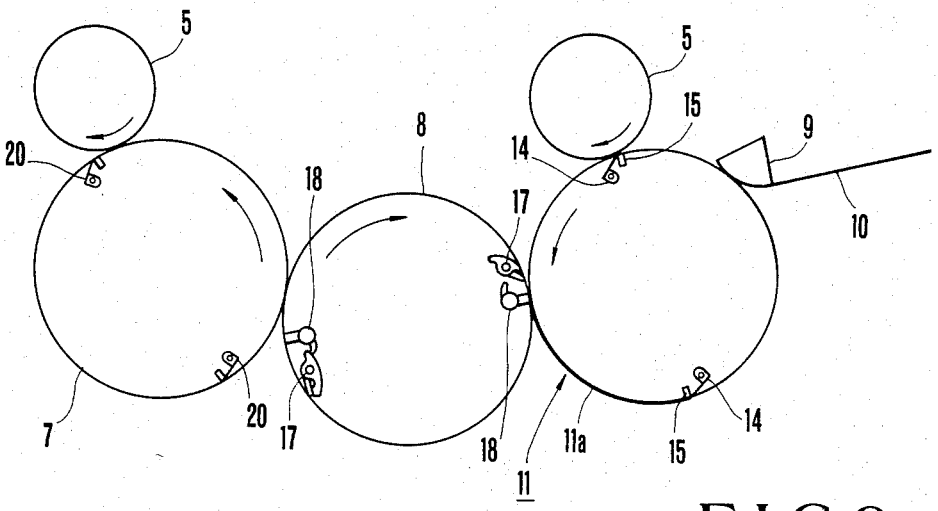
FIGS. 9*a* through 9*c* show successive steps of both side printing.
Figure 9B:
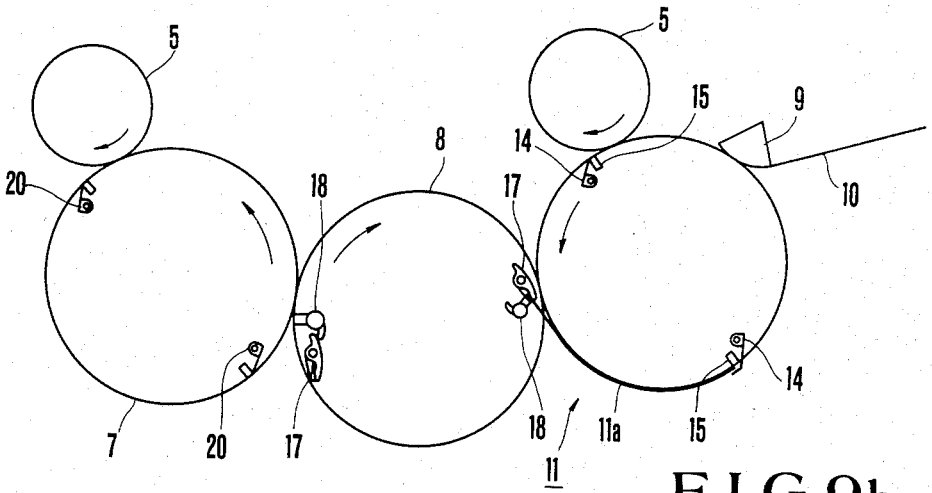
Figure 9C:
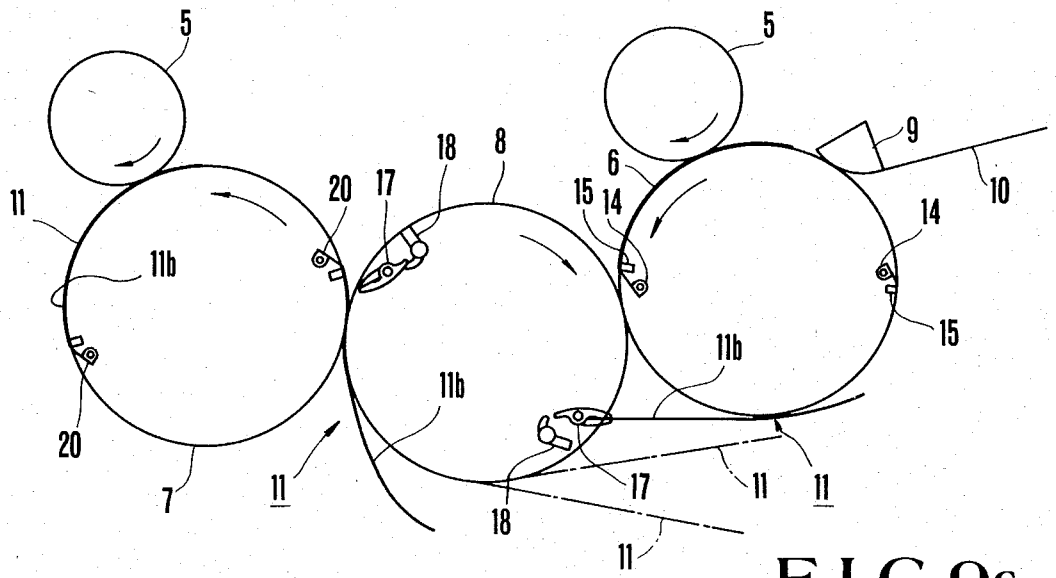

The operation of the double side printing of the printing press described above will be described with reference to FIGS. 9*a* through 9*c*. Thus, a sheet of paper 11 fed onto the feedboard 10 one after another is gripped by the grippers of the swing pre-gripper 9 and conveyed. Then, the sheet of paper 11 is gripped by the grippers 14 and the gripper supports 15 of the impression cylinder 6 to be wrapped about the periphery of the impression cylinder 6 as it is rotated. As the paper sheet passes between the blanket cylinder 5*a* and the impression cylinder 6 the surface 11*a* of the paper sheet is printed, and the paper sheet 11 is held in the wrapped state about the periphery of the impression cylinder 6 during an interval between an instant at which its leading end passes through the contact point between the impression cylinder 6 and the turn-over cylinder 8 and an instant at which the trailing end reaches the contact point between both cylinders 6 and 8 as shown in FIG. 9*a*. Immediately after the gripper supports 15 have passed the contact point between the cylinders 6 and 8, the air port 26 of the bearer 6*b* begins to confront the slot 27 of the stationary valve 23. Accordingly, the air flows into the air passage 30 through hose 31, slot 27 and air port 26 and then blown into a gap between the paper sheet 11 and the peripheral surface of the impression cylinder 6 via air tube 34 and the air blow out opening 33 of each gripper support 15. This air blast is continued until the trailing end of the paper sheet passes through the contact point between both cylinders so as to peel off paper sheets 11 from the periphery of the impression cylinder 6 which has been adhered there to by the contact pressure between the blanket cylinder 5 and the impression cylinder 6. When the trailing end of the paper sheet 11 reaches the contact point between both cylinders 6 and 8, the suction device of the turn-over cylinder 8 operates to suck the trailing end against the suction head. As above described, at this time, the paper sheet is peeled off from the impression cylinder 6 so that the trailing end can readily be sucked. When sucked in this manner the trailing end of the sheet of paper is received between the opened ends of the turn-over grippers 17 and since these grippers are closed concurrently with the suction the trailing end is gripped by the turn-over grippers 17. FIG. 9B shows this state. As cylinders 6 and 8 are rotated further, the paper sheet is released from between the grippers 14 and the gripper supports 15, so that the sheet of paper 11 is conveyed to the turn-over cylinder 7 with its rear side 11*b* contacted with the turn-over cylinder 8 and then grippd by the grippers of the impression cylinder 7 at the contact point between the same and the turn-over cylinder 8 as shown in FIG. 9*c*. Accordingly, the rear side 11*b* of the paper sheet 11 is printed by the impression cylinder 7 and the blanket roller 5, thus effecting both side printing.

As above described, according to this invention, in a sheet fed printing press with an inverting mechanism provided with a paper sucking device, a gripper support of an impression cylinder is provided with an air blow out opening at the interface between its paper clamping surface and the peripheral surface of the impression cylinder and the air blow out opening is connected to a source of air for blowing air into a gap between the paper sheet before it is sucked and the periphery of the impression cylinder so as to peel off the paper sheet adhered to the peripheral surface of the impression cylinder by the printing pressure. Consequently, the trailing end of the paper sheet to be turned over can readily be sucked by the sucking device and the transfer of the paper sheet can be effected positively without failure of gripping.

What is claimed is:

1. In a sheet-fed printing press provided with a turn over mechanism in which a trailing end of a sheet of paper, wrapped about an impression cylinder, and gripped by a gripper mechanism carried by said impression cylinder, is sucked by a suction device of a turn-over cylinder in contact with said impression cylinder and transferred from said suction device and gripped by the turn-over grippers of said turn-over cylinder to be turned over, the improvement which comprises an orifice at an interface between a paper clamping surface of a gripper support cooperating with said impression cylinder gripper and a peripheral surface of said impression cylinder, said orifice being formed in said gripper support of said impression cylinder, means for connecting said orifice to a source of air and means for supplying air to said orifice in timed relation to actuation of said turn-over grippers to release said sheet and to separate said released end of said sheet from said impression cylinder.

2. The sheet-fed printing press according to claim 1 wherein one side of said orifice facing a side surface of said impression cylinder has a triangular shape.

3. The sheet-fed printing press according to claim 1 wherein said last mentioned means comprises an air passage axially extending through said impression cylinder near its peripheral portion, means for connecting said orifice to said air passage, a pair of arcuate stationary valves in air tight sealing contact with the peripheral surface of said impression cylinder on both side thereof, each of said arcuate valves being provided with an elongated slot connected to said source of air, and openings provided for said impression cylinder for connecting said air passage with said slots.

* * * * *